US010829896B2

(12) United States Patent
Johnston

(10) Patent No.: US 10,829,896 B2
(45) Date of Patent: Nov. 10, 2020

(54) INDUCTIVE RAIL HEATING HEAD FOR A MOVING-POINT TRAIN TRACK RAIL AND A FIXED TRAIN TRACK RAIL

(71) Applicant: Jeffrey Ross Johnston, Jacksonville, FL (US)

(72) Inventor: Jeffrey Ross Johnston, Jacksonville, FL (US)

( * ) Notice: Subject to any disclaimer, the term of this patent is extended or adjusted under 35 U.S.C. 154(b) by 266 days.

(21) Appl. No.: 16/152,117

(22) Filed: Oct. 4, 2018

(65) Prior Publication Data

US 2019/0032281 A1 Jan. 31, 2019

Related U.S. Application Data

(63) Continuation-in-part of application No. 15/834,038, filed on Dec. 6, 2017, now Pat. No. 10,626,560, and a continuation-in-part of application No. 15/062,290, filed on Mar. 7, 2016, now abandoned.

(60) Provisional application No. 62/567,992, filed on Oct. 4, 2017, provisional application No. 62/430,460, filed on Dec. 6, 2016, provisional application No. 62/166,497, filed on May 26, 2015, provisional application No. 62/128,851, filed on Mar. 5, 2015.

(51) Int. Cl.

| | |
|---|---|
| ***H05B 6/10*** | (2006.01) |
| ***H05B 6/08*** | (2006.01) |
| ***B61L 25/04*** | (2006.01) |
| ***E01B 7/24*** | (2006.01) |
| ***H05B 6/40*** | (2006.01) |

(52) U.S. Cl.
CPC ..... *E01B 7/24* (2013.01); *H05B 6/101* (2013.01); *H05B 6/40* (2013.01)

(58) Field of Classification Search
CPC ..... E01B 7/24; H05B 6/40; H05B 6/101
USPC ..... 219/600, 213, 628, 635, 672, 675, 676, 219/660, 662, 610, 617; 246/428, 122 R
See application file for complete search history.

(56) References Cited

U.S. PATENT DOCUMENTS 3,559,820 A * 2/1971 Munson ..... G05B 19/231 414/21
7,253,380 B2 * 8/2007 Miller ..... B23K 9/0213 219/617

FOREIGN PATENT DOCUMENTS

CN 206086029 U * 4/2017

* cited by examiner

*Primary Examiner* — Quang T Van

(57) ABSTRACT

A heating device for removing snow or ice that accumulates in between a moving-point train track rail and a fixed train track rail consists of an induction coil, a holding case, and a mounting tray. The induction coil is positioned within the holding case which is then positioned on the mounting tray. For optimal performance, the mounting tray is positioned adjacent a planar bottom surface of both the fixed train track rail and the moving-point train track rail. The eddy current field of the induction coil excites the atoms within the steel which then results in elevated temperatures. The heat radiated from the fixed train track rail and the moving-point train track rail removes any accumulated snow or ice.

9 Claims, 5 Drawing Sheets

INDUCTIVE RAIL HEATING HEAD FOR A MOVING-POINT TRAIN TRACK RAIL AND A FIXED TRAIN TRACK RAIL

The current application claims a priority to the U.S. Provisional Patent application Ser. No. 62/567,992 filed on Oct. 04, 2017.

FIELD OF THE INVENTION

The present invention relates generally to railroad heating devices. More specifically, the present invention introduces a heating head that utilizes a single magnetic induction coil to simultaneously heat a moving-point train track rail and a fixed train track rail.

BACKGROUND OF THE INVENTION

Railroad switches are used to guide a train from one track to another. The railroad switches consist of a moving-point train track rail and a fixed train track rail which are positioned in parallel to each other. The moving-point train track rail has the capability to shift positions and enable redirection. The space between the moving-point rail and the fixed train track rail is vulnerable to hold snow or ice during cold weather conditions. The snow build-up during cold weather conditions can affect the overall functionality and longevity of the railroad switch.

Various heating methods are currently used to remove snow or ice that builds up in between the moving-point train track rail and the fixed train track rail. The use of cal-rod units is one such method that generates heat along the train track rail. Even though cal-rod units have certain benefits, there are notable drawbacks that need to be addressed as well. As an example, cal-rod units draw a substantial amount of current to heat the rail. Generally, 480-volts of power is required to generate 500 Watts per foot of the train track rail. The high voltage electrifies the railroad switch and generates a temperature of 160-Fahrenheit. Thus, the overall cost related to cal-rod units can be financially disadvantageous. The length of the cal-rod units is another disadvantage. Based upon the length of the train track rail that needs to be heated, the required length of the cal-rod unit can be up to 30-feet long.

The objective of the present invention is to address the aforementioned issues. To do so, the present invention introduces a heating head that can be used to simultaneously heat both the moving-point train track rail and the fixed train track rail using minimum energy. By doing so, the present invention generates temperatures of up to 300-Fahrenheit. The safety concerns related to existing heating systems are also eliminated by through the present invention.

DETAIL DESCRIPTIONS OF THE INVENTION

All illustrations of the drawings are for the purpose of describing selected versions of the present invention and are not intended to limit the scope of the present invention.

The present invention introduces a heating head that is used in the process of removing snow or ice that accumulates between a moving-point train track rail and a fixed train track rail. By utilizing the present invention, heat can be induced in a large area with minimum power. Furthermore, the design of the present invention reduces the overall cost and safety issues related to existing heating systems.

Figure 1A:
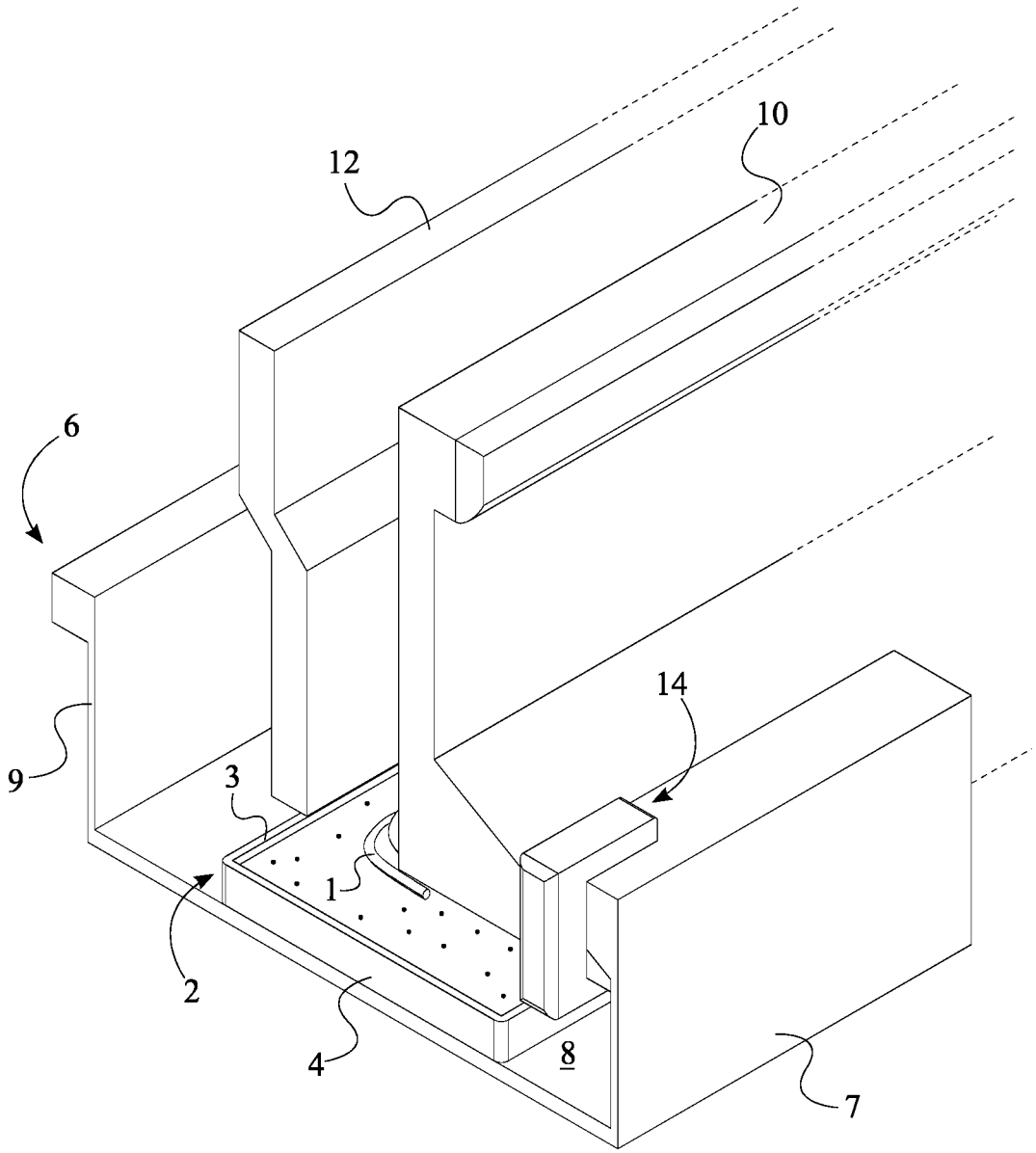
FIG. 1A is a perspective view of the present invention being used with a fixed train track rail and a moving-point train track rail.
Figure 1B:
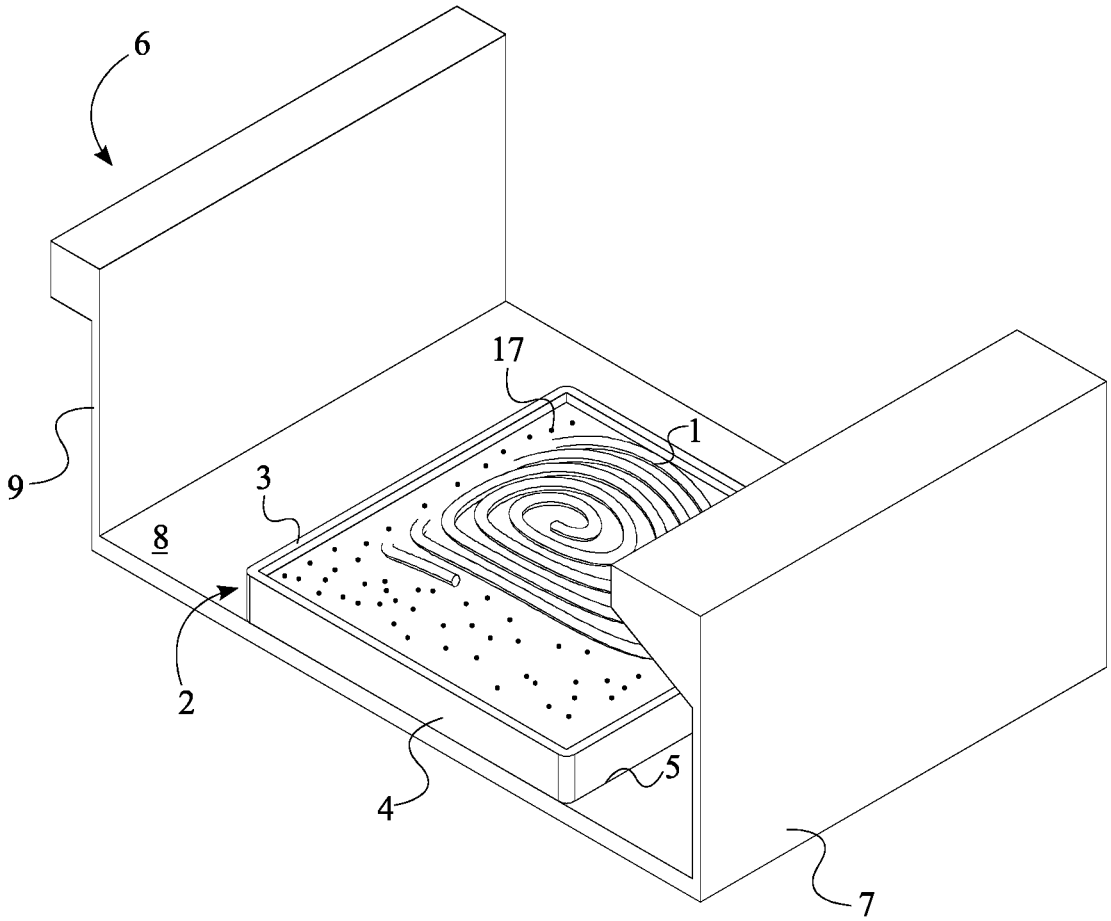
FIG. 1B is a perspective view of the holding case, the induction coil, and the mounting tray.
Figure 2:
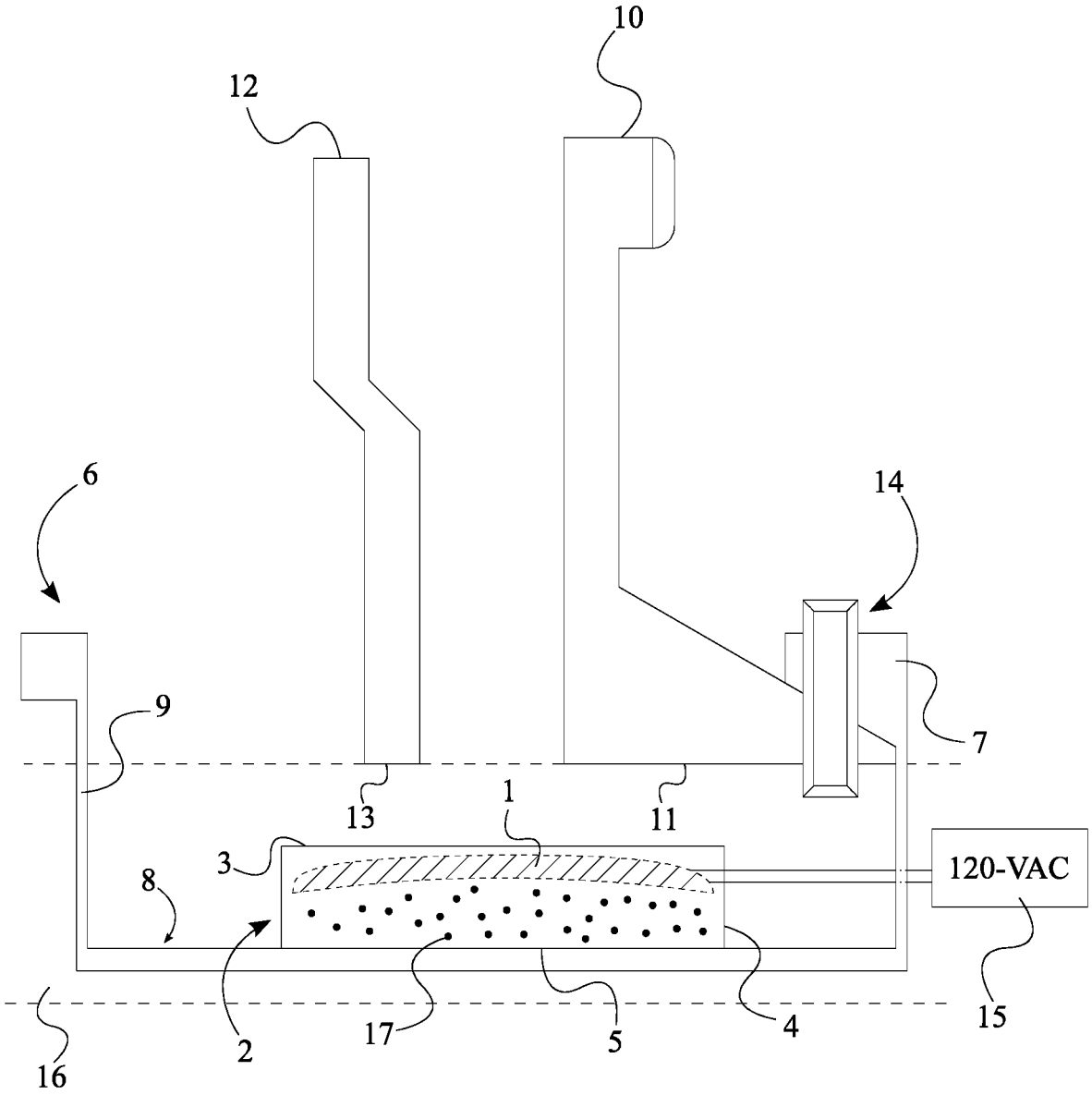
FIG. 2 is a front view of the present invention being used with a fixed train track rail and a moving-point train track rail.
Figure 3:
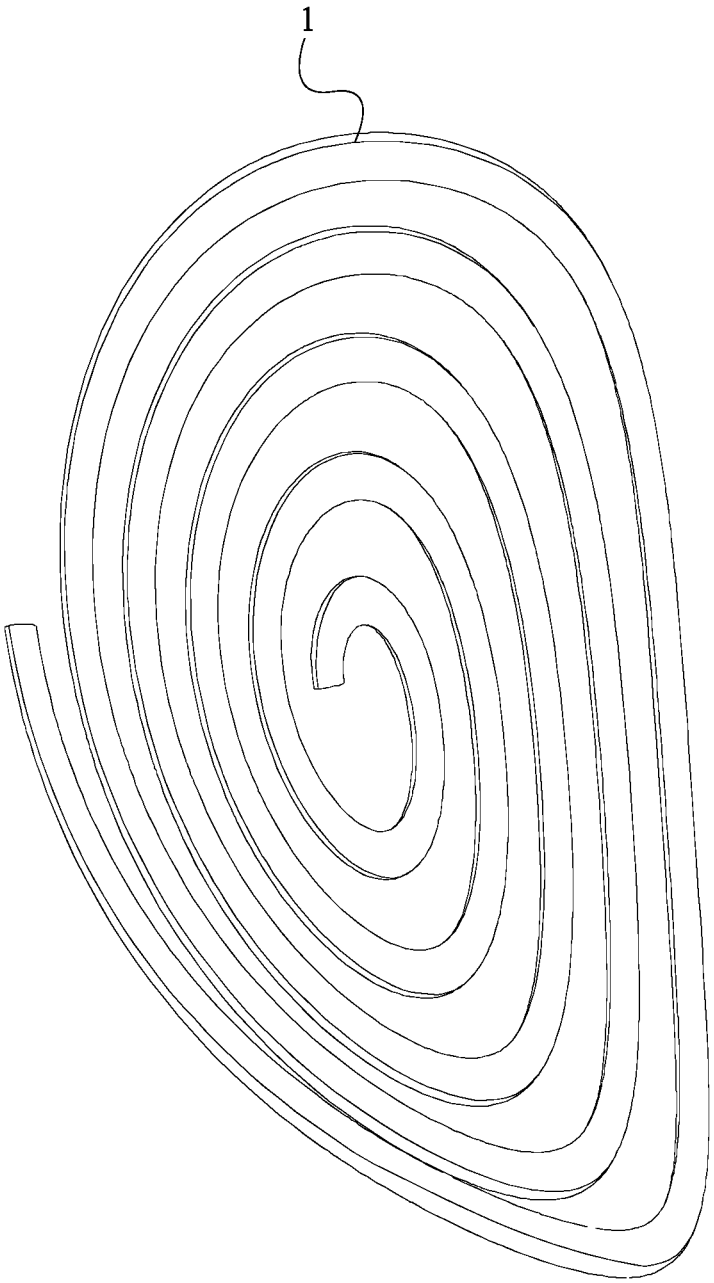
FIG. 3 is a perspective view of the induction coil.
Figure 4:
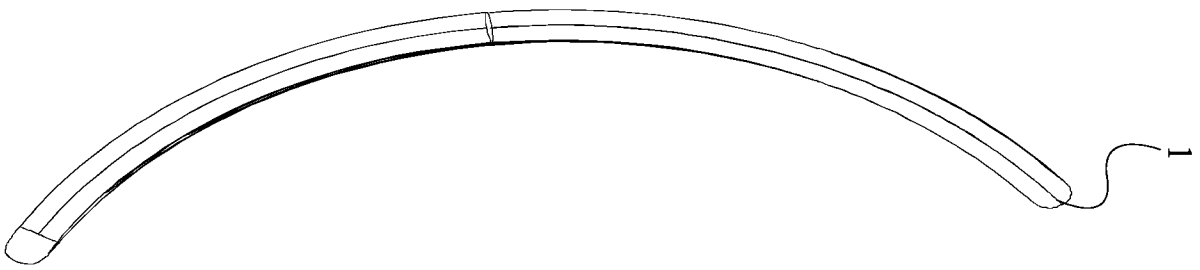
FIG. 4 is a side view of the induction coil.

As illustrated in FIG. 1A, FIG. 1B, and FIG. 2, to fulfill the intended functionalities, the present invention comprises an induction coil 1, a holding case 2, and a mounting tray 6. The induction coil 1 is used to create the eddy current field that will generate heat within a moving-point train track rail 12 and a fixed train track rail 10. In the preferred embodiment of the present invention, the induction coil 1 is a pancake induction coil that is oblong and concave in shape as seen in FIG. 3 and FIG. 4. The oblong concave shape is vital to create a wide eddy current field that will span across both the fixed train track rail 10 and the moving-point train track rail 12 when the present invention is mounted underneath the fixed train track rail 10 and the moving-point train track rail 12. To provide electrical insulation, the induction coil 1 is coated in a high-temperature magnetic wire enamel. The eddy current field generated from the induction coil 1, excites the atoms within the material of both the fixed train track rail 10 and the moving-point train track rail 12. Since steel is generally used to manufacture train track rails, the atoms within the steel of the fixed train track rail 10 and the moving-point train track rail 12 will be excited. The activation of the atoms results in elevated temperatures within the fixed train track rail 10 and the moving-point train track rail 12. The heat radiated from both the fixed train track rail 10 and the moving-point train track rail 12 results in melting any snow or ice that is accumulated in between the fixed train track rail 10 and the moving-point train track rail 12. Since the induction coil 1 does not generate any heat within the induction coil 1, the present invention provides a safe working environment for the maintenance personnel.

As seen in FIG. 2, the present invention is positioned adjacent a planar bottom surface 11 of the fixed train track rail 10 and a planar bottom surface 13 of the moving-point train track rail 12. The holding case 2 is used to position the induction coil 1 adjacent the planar bottom surface 11 of the fixed train track rail 10 and the planar bottom surface 13 of the moving-point train track rail 12. The mounting tray 6 is used to establish a connection with the fixed train track rail 10, and the moving-point train track rail 12. The mounting tray 6 is designed to accommodate the shift of the moving-point train track rail 12 which is generally about to 7-inches. The positioning of the present invention is vital to induce eddy current magnetic fields on both the fixed train track rail 10 and the moving-point train track rail 12.

As seen in FIG. 1B, to hold and orient the induction coil 1 as required, the holding case 2 comprises a rail-facing top surface 3, a structural body 4, and a tray-facing bottom surface 5. The rail-facing top surface 3 and the tray-facing bottom surface 5 are positioned opposite to each other across the structural body 4 such that a distance between the rail-facing top surface 3 and the tray-facing bottom surface 5 determines an overall thickness of the holding case 2. In other words, the structural body 4 extends from the rail-facing top surface 3 to the tray-facing bottom surface 5. The size and overall shape of the holding case 2 can be different from one embodiment to another. For the induction coil 1 to induce eddy current magnetic fields onto the moving-point train track rail 12 and the fixed train track rail 10, the induction coil 1 is positioned within the holding case 2 adjacent the rail-facing top surface 3. On the other hand, the tray-facing bottom surface 5 is pressed against a receiving surface 8 of the mounting tray 6 such that the holding case 2 remains stationary within the mounting tray 6. The holding case 2 further comprises an electrically-insulative potting 17 that protects the induction coil 1 from varying weather conditions and vibrations. To do so, the induction coil 1 is positioned within the holding case 2 by the electrically-insulative potting 17. The electrically-insulative potting 17 can be, but is not limited to, fiberglass resin. Preferably, the holding case 2 will be designed to be waterproof.

As discussed earlier, the present invention is used in the process of removing snow or ice from the area in between a fixed train track rail 10 and a moving-point train track rail 12. For optimal performance, the present invention is positioned adjacent a planar bottom surface 11 of the fixed train track rail 10 and a planar bottom surface 13 of the moving-point train track rail 12. The holding case 2 is positioned adjacent and in parallel to the planar bottom surface 11 of the fixed train track rail 10. The holding case 2 is also positioned adjacent and in parallel to the planar bottom surface 13 of the moving-point train track rail 12. Since the induction coil 1 is adjacent the rail-facing top surface 3 of the holding case 2, the induction coil 1 will also be positioned adjacent the planar bottom surface 11 of the fixed train track rail 10 and the planar bottom surface 13 moving-point train track rail 12. In the resulting position, the holding case 2 will be positioned in between the mounting tray 6 and the planar bottom surface 11 of the fixed train track rail 10 and planar bottom surface 13 of the moving-point train track rail 12.

As seen in FIG. 1A and FIG. 2, the present invention further comprises an attachment mechanism 14 that is utilized to establish a connection between the mounting tray 6, the fixed train track rail 10, and the moving-point train track rail 12. The mounting tray 6 comprises a first rail-bracing lateral wall 7 and a second lateral wall 9. The mounting tray 6 is designed to connect to the fixed train track rail 10 and accommodate the shift of the moving-point train track rail 12. To do so, the first rail-bracing lateral wall 7 is terminally and perpendicularly connected to the receiving surface 8. On the other hand, the second lateral wall 9 is terminally and perpendicularly connected to the receiving surface 8 opposite the first rail-bracing lateral wall 7 across the receiving surface 8. As a result, the receiving surface 8 will be positioned in between the first rail-bracing lateral wall 7 and the second lateral wall 9.

When the mounting tray 6 is attached, the first rail-bracing lateral wall 7 is externally mounted to a body of the fixed train track rail 10 opposite the moving-point train track rail 12 through the attachment mechanism 14. In the resulting position, the second lateral wall 9 is positioned adjacent the moving-point train track rail 12 opposite the fixed train track rail 10. More specifically, the second lateral wall 9 is positioned to allow the moving-point train track rail 12 to have a full range of motion. When the first rail-bracing lateral wall 7 and the second lateral wall 9 are appropriately positioned, the receiving surface 8 of the mounting tray 6 is positioned in parallel to the planar bottom surface 11 of the fixed train track rail 10. The receiving surface 8 is connected to a railroad tie 16 opposite the holding case 2 so that the mounting tray 6 is secured at the receiving surface 8. In the preferred embodiment of the present invention, the attachment mechanism 14 comprises at least one fork clamp. However, the attachment mechanism 14 can vary in different embodiments of the present invention.

To provide the required electric power to the induction coil 1, the present invention further comprises an external power supply 15 that is electrically connected to the induction coil 1. In the preferred embodiment of the present invention, the external power supply 15 is a 120-Volt alternating current (AC) power supply. However, in other embodiments of the present invention different voltages can be used for the external power supply 15. Most existing heating methods utilize a 480-Volt AC power supply to generate 500-Watts of heat per foot of the train track rail. In contrast to existing heating methods, the present invention utilizes a comparatively low voltage level in the external power supply 15.

Although the invention has been explained in relation to its preferred embodiment, it is to be understood that many other possible modifications and variations can be made without departing from the spirit and scope of the invention as hereinafter claimed.

What is claimed is:

1. An inductive rail heating head for moving point rail and fixed rail comprises:
- an induction coil;
- a holding case;
- a mounting tray;
- the holding case comprises a rail-facing top surface, a structural body, and a tray-facing bottom surface;
- the rail-facing top surface and the tray-facing bottom surface being positioned opposite to each other across the structural body;
- the induction coil being positioned within the holding case adjacent the rail-facing top surface; and
- the tray-facing bottom surface being pressed against a receiving surface of the mounting tray.

2. The inductive rail heating head for moving point rail and fixed rail as claimed in claim 1, wherein the induction coil has an oblong, concave shape.

3. The inductive rail heating head for moving point rail and fixed rail as claimed in claim 1 further comprises:
- the holding case further comprises an electrically-insulative potting; and
- the induction coil being positioned within the holding case by the electrically-insulative potting.

4. The inductive rail heating head for moving point rail and fixed rail as claimed in claim 1 further comprises:
- a fixed train track rail;
- a moving-point train track rail;
- the fixed train track rail and the moving-point train track rail each comprise a planar bottom surface;
- the holding case being positioned adjacent to and in parallel to the planar bottom surface of both the fixed train track rail and the moving-point train track rail;
- the induction coil being positioned adjacent to the planar bottom surface of both the fixed train track rail and the moving-point train track rail; and
- the holding case being positioned in between the mounting tray and the bottom surface of both the fixed train track rail and the moving-point train track rail.

5. The inductive rail heating head for moving point rail and fixed rail as claimed in claim 1 further comprises:
- an attachment mechanism;
- the mounting tray comprises a first rail-bracing lateral wall and a second lateral wall;
- the first rail-bracing lateral wall being terminally and perpendicularly connected to the receiving surface;

the second lateral wall being terminally and perpendicularly connected to the receiving surface opposite the first rail-bracing lateral wall across the receiving surface;

the first rail-bracing lateral wall being externally mounted to a body of a fixed train track opposite a moving-point train track rail through the attachment mechanism; and the second lateral wall being positioned adjacent the moving-point train track rail opposite the fixed train track rail.

6. The inductive rail heating head for moving point rail and fixed rail as claimed in claim 5, wherein the attachment mechanism comprises at least one fork clamp.

7. The inductive rail heating head for moving point rail and fixed rail as claimed in claim 1 further comprises:

an external power supply;

the external power supply being electrically connected to the induction coil.

8. The inductive rail heating head for moving point rail and fixed rail as claimed in claim 7, wherein the power supply is a 120-Volt alternating current power supply.

9. The inductive rail heating head for moving point rail and fixed rail as claimed in claim 1, wherein the holding case is waterproof.

* * * * *